US011284659B2

(12) United States Patent
Vanos

(10) Patent No.: US 11,284,659 B2
(45) Date of Patent: Mar. 29, 2022

(54) BRA ADAPTER FOR CONVERTING A STANDARD BRA INTO A NURSING BRA

(71) Applicant: Robilyn Elizabeth Vanos, Waterloo (CA)

(72) Inventor: Robilyn Elizabeth Vanos, Waterloo (CA)

( * ) Notice: Subject to any disclaimer, the term of this patent is extended or adjusted under 35 U.S.C. 154(b) by 0 days.

(21) Appl. No.: 16/004,825

(22) Filed: Jun. 11, 2018

(65) Prior Publication Data

US 2018/0352884 A1 Dec. 13, 2018

(51) Int. Cl.

| | |
|---|---|
| ***A41F 1/00*** | (2006.01) |
| ***A41C 3/04*** | (2006.01) |
| ***A41C 3/00*** | (2006.01) |
| ***A41F 15/00*** | (2006.01) |

(52) U.S. Cl.

CPC ..... *A41F 1/006* (2013.01); *A41C 3/0028* (2013.01); *A41C 3/04* (2013.01); *A41F 15/002* (2013.01)

(58) Field of Classification Search

CPC ..... A41C 3/04; A41C 3/0028; A41F 1/006; A41F 15/002

See application file for complete search history.

(56) References Cited

U.S. PATENT DOCUMENTS 1,607,810 A * 11/1926 Behnke ..... A41F 15/002 2/304
1,632,716 A * 6/1927 Schweigert ..... A41F 15/002 2/333
2,111,664 A * 3/1938 Gross ..... A41F 15/002 24/682.1
6,298,527 B1 * 10/2001 Fildan ..... A41C 3/00 24/578.11
2002/0022434 A1 * 2/2002 Plourde ..... A41F 1/006 450/86
2004/0020240 A1 * 2/2004 Brancato ..... A44C 11/007 63/3
2006/0070214 A1 * 4/2006 Hsu ..... A41F 15/002 24/170
2006/0135039 A1 * 6/2006 Fildan ..... A41F 15/002 450/82
2006/0282934 A1 * 12/2006 Fildan ..... A41F 15/002 2/86
2007/0214549 A1 * 9/2007 Carr ..... A41D 1/215 2/312
2008/0146118 A1 * 6/2008 Solberg ..... A61M 1/066 450/1

* cited by examiner

*Primary Examiner* — Gloria M Hale

(57) ABSTRACT

The invention comprises a device and method for converting a standard bra into a nursing bra. The device comprises an upper assembly having an upper fastener attached to a first portion of a quick release fastener, the upper fastener being configured for securely gripping a severed shoulder strap; a lower assembly comprising a lower fastener attached to a second portion of the quick release fastener, the lower fastener being configured for securely gripping a severed breast cup strap; and optionally including a sling strap having a top end and a bottom end, wherein the sling strap top end is attached to the upper assembly and wherein the sling strap bottom end is attached to a band fastener which is configured for securely gripping a bra torso band; wherein the quick release fastener first and second portions can be selectively coupled and uncoupled.

52 Claims, 9 Drawing Sheets

- Prior Art -

- Prior Art -

- Prior Art -

- Prior Art -

- Prior Art -

- Prior Art -

BRA ADAPTER FOR CONVERTING A STANDARD BRA INTO A NURSING BRA

FIELD

This invention relates to wear apparel for women, and more particularly to a nursing bra accessory device and method.

BACKGROUND

A variety of nursing bra garments for women have previously been devised. Typically, such garments have employed a fastener to temporarily release or remove a portion of the garment and thereby expose a breast to provide the child access to its mother's breast for breast-feeding.

Currently the mainstream options for obtaining a nursing bra are essentially limited to: 1) purchasing a commercially-available nursing bra having fastener and sling portions intended for selectively exposing the breast for nursing; or 2) modifying a standard (non-nursing) bra to convert the standard bra into a nursing bra by cutting and sewing the bra to insert a fastener and a sling portion. Unfortunately the selection of commercially available nursing bras tend to offer options that can be expensive and quite limited in terms of fit, style and quality. Modifying a standard bra to convert it into a nursing bra may be an attractive alternative if not for the need for parts assembly and sewing—time-consuming and laborious tasks not appealing or realistic to many nursing mothers.

Prior to the invention of the present disclosure there had not existed a quick, simple device and method requiring minimal time and skill for converting a standard bra into a nursing bra.

The invention has been developed primarily to provide a device and method to facilitate easy conversion of a bra from a standard bra to a nursing bra, and is described with reference to this application.

SUMMARY OF THE INVENTION

It is an object of the present invention to overcome or ameliorate at least one of the disadvantages of the prior art, or to provide a useful alternative.

The invention comprises a device for converting a standard bra into a nursing bra. One embodiment comprises: an upper assembly comprising an upper fastener attached to a first portion of a quick release fastener, the upper fastener being configured for securely gripping a severed shoulder strap; a lower assembly comprising a lower fastener attached to a second portion of the quick release fastener, the lower fastener being configured for securely gripping a severed breast cup strap; a band fastener configured for securely gripping a bra torso band; and a sling strap having a top end and a bottom end, wherein the sling strap top end is attached to the upper assembly and wherein the sling strap bottom end is attached to the band fastener; wherein the quick release fastener first and second portions can be selectively coupled and uncoupled.

One embodiment of a method of converting a standard bra into a nursing bra using the aforementioned device comprises the steps of: 1) severing the bra shoulder strap into a shoulder strap portion having a shoulder strap severed end, and a cup strap portion having a cup strap severed end; 2) fastening the upper fastener over the shoulder strap severed end to securely attach it to the bra shoulder strap portion; 3) fastening the lower fastener over the cup strap severed end to securely attach it to the cup strap portion; and 4) fastening the band fastener over a lower edge of the torso band or bra cup to securely attach it thereto, whereby the band fastener is engaged such that during use the sling strap extends from an interior side of the torso band; whereby steps 2) through 4) may be performed in any order. The aforementioned method of converting a standard bra into a nursing bra may include the steps of: adjusting the length of the sling strap and/or bra shoulder strap portions; locking the upper fastener, lower fastener and/or band fastener.

Alternatively, a method of converting a standard bra into a nursing bra using the aforementioned device may comprise the steps of: 1) fastening the band fastener over a lower edge of the torso band to securely attach it thereto, whereby the band fastener is fastened such that the sling strap extends from an interior side of the torso band to intersect the bra shoulder strap at the upper assembly; 2) severing the bra shoulder strap into a shoulder strap portion having a shoulder strap severed end, and a cup strap portion having a cup strap severed end, wherein the bra shoulder strap is severed at a location which is determined by the intersection of the upper assembly and the bra shoulder strap; 3) fastening the upper fastener over the shoulder strap severed end to securely attach it to the bra shoulder strap portion; and 4) fastening the lower fastener over the cup strap severed end to securely attach it to the cup strap portion; whereby steps 3) through 4) may be performed in any order. The aforementioned method of converting a standard bra into a nursing bra may include the steps of: adjusting the length of the sling strap and/or bra shoulder strap portions; locking the upper fastener, lower fastener and/or band fastener.

Another embodiment of the device of the present application comprises a quick release fastener having first and second portions, wherein the first portion is connected to an upper fastener and the second portion is connected to a lower fastener. A retaining structure may be provided on an upper assembly unit, which unit includes the quick release fastener first portion and upper fastener, said retaining structure providing an attachment location for a sling strap top end.

The upper fastener, lower fastener and/or band fastener of the device of the present invention may comprise a jaw having opposing jaw portions and a hinge member, wherein the jaw portions are pivotable at the hinge member to move the jaw between opened and closed states, and wherein the jaw portions comprise gripping features on inside surfaces thereof. The gripping features may include teeth, spikes, barbs, a high-friction material, or a combination thereof. The teeth, spikes and/or barbs may be configured to pierce the bra shoulder strap and/or torso band when fastened. The high friction material may comprise a natural or synthetic rubber. The band fastener may be configured for gripping the bra torso band over a lower edge thereof. The band fastener further may comprise a band fastener retaining structure that is configured for retaining the sling strap bottom end thereon, wherein the band fastener retaining structure is positioned at a superior region and on an inside portion of the band fastener. The upper fastener may be formed integrally with the quick release fastener first portion, or the upper fastener may be attached to the quick release fastener first portion via a linking element. The lower fastener may be formed integrally with the quick release fastener second portion, or the lower fastener may be attached to the quick release fastener second portion via a linking element. The upper fastener, lower fastener and/or band fastener further may comprise a locking mechanism for locking the jaw in the closed state. The locking mechanism may comprise a locking lever, slider, toggle, ratchet, deformable tab, dial, screw, or any combination thereof. The locking mechanism may be manipulated by hand, or the locking mechanism may require the use of a tool for manipulation thereof. The upper fastener, lower fastener and/or band fastener may be releasable or non-releasable. The upper fastener, lower fastener and/or band fastener may comprise at least one piercing member. The upper fastener, lower fastener and/or band fastener may be a crimp, a clasp, a clamp, a snap, a suspender clip or an alligator clip. The upper fastener, lower fastener and/or band fastener may include a biasing member. The upper fastener, lower fastener and/or band fastener may feature a flat or low profile when fastened so as to be invisible under clothing. The upper fastener, lower fastener and/or band fastener may comprise plastic and/or metal and/or a painted surface coating. The sling strap may be adjustable in length. The band fastener may comprise multiple fasteners positioned along the span of the sling strap bottom end. The sling strap may comprise an elastic material. The quick release fastener may comprise a nursing bra clip, a hook and loop fastener, a button and loop closure, a snap closure, a hook and eye closure, or a magnetic closure. The quick release fastener may be coupled and uncoupled using a single hand. The quick release fastener first portion may be positioned proximally to the body of the wearer compared to the quick release fastener second portion when the fastener portions are coupled while the bra is being worn. The quick release fastener first portion may be located superiorly relative to the quick release fastener second portion when the fastener portions are coupled while the bra is being worn.

BRIEF DESCRIPTION OF THE DRAWINGS

Several embodiments of the invention will now be described, by way of example only, with reference to the accompanying drawings in which.

DETAILED DESCRIPTION OF THE PREFERRED EMBODIMENTS

Figure 1:
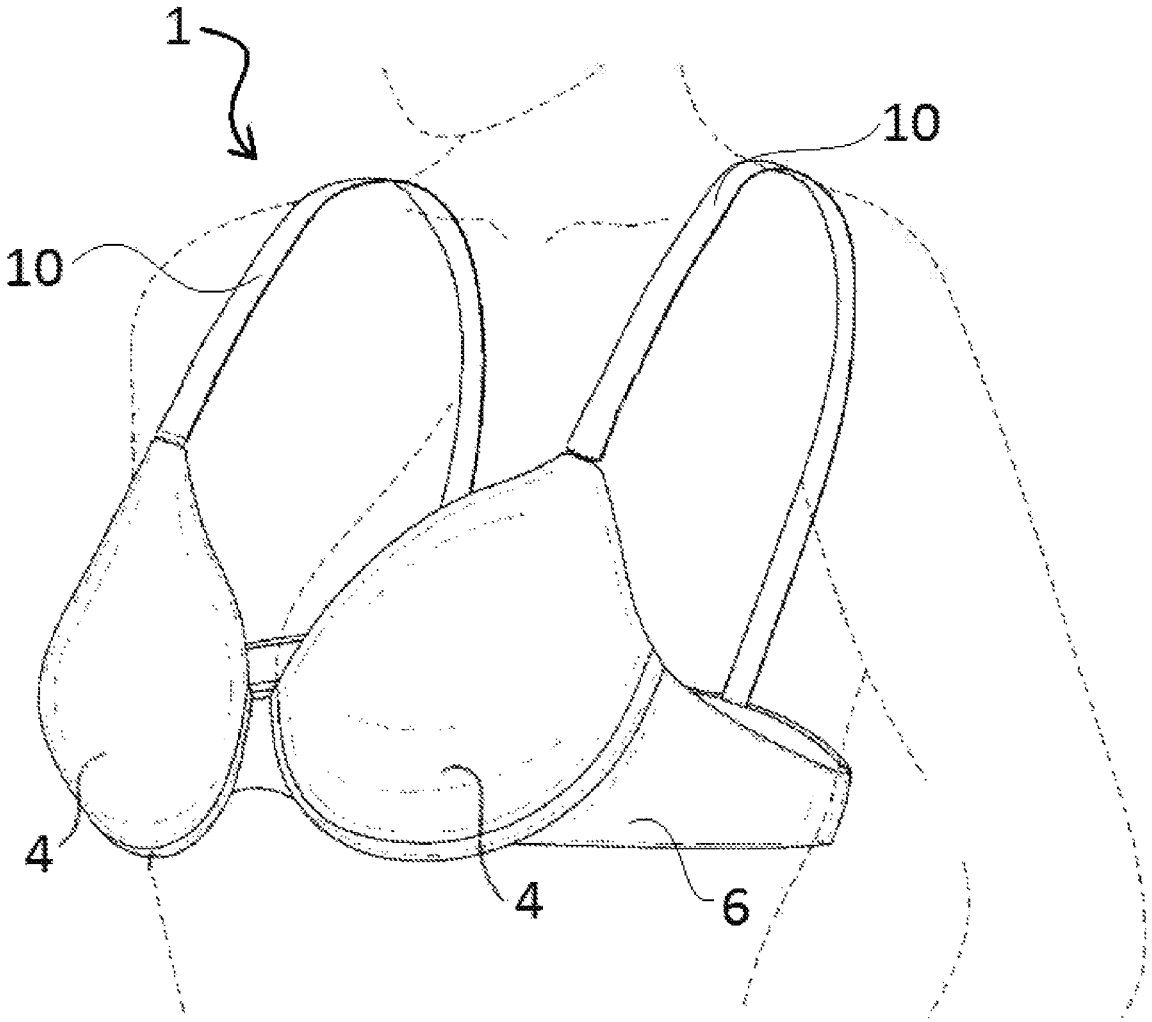
FIG. 1 depicts a standard bra of the prior art.

For the purposes of this application the term "standard bra" shall be construed to include any wearable garment which comprises at least one shoulder strap, at least one breast cup and a torso band. The term "standard bra" is used throughout the application to denote a conventional bra which does not have the typical nursing bra features such as quick release fasteners and sling straps. The term "standard bra" shall be construed to encompass any type of bra known to a person of skill in the art, including but not limited to: sports bras, bandeau style bras, camisoles or tank tops having shelf bras, swimwear bras, bras having straps of various configurations such as racerback, halter, removable or one-shouldered configurations, and bras with or without support structures such as underwires and padding. The term "breast cup" shall be construed to include any covering over the breast for the purpose of covering and contributing support to the breast and may comprise a variety of materials and designs. An example of a standard bra 1 of the prior art, as illustrated in FIG. 1, comprises two shoulder straps 10 permanently attached at front ends to breast cups 4 and at rear ends to a torso band 6, which torso band 6 encircles the torso of the wearer and is also attached to the breast cups 4. The term "torso band" shall be construed as comprising the lower edge portion of the garment which encircles the torso of the wearer and which functions to hold the breast cups in place. The torso band shall be construed as including the lower edge of the breast cup(s) if these happen to occupy the lowest perimeter edge of the garment at any point. The standard bra may optionally include closure and/or sizing elements which may be located anywhere along the bra band, shoulder straps or breast cups.

Figure 2A:
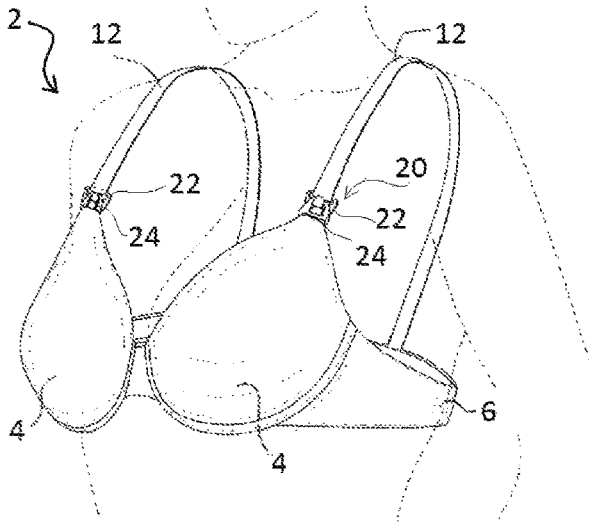
FIG. 2A depicts a top-opening nursing bra of the prior art having a known quick release fastener in its coupled configuration.
Figure 2B:
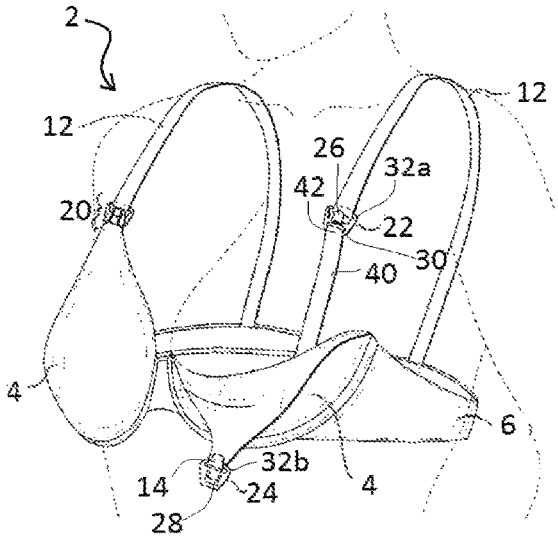
FIG. 2B depicts a top-opening nursing bra of the prior art having a known quick release fastener in its uncoupled configuration.
Figure 2C:
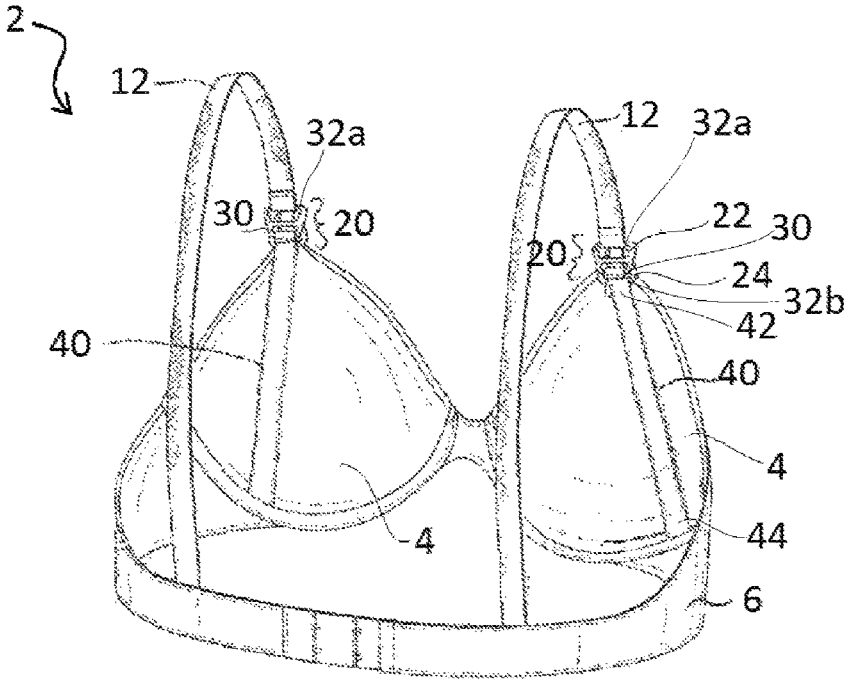
FIG. 2C depicts a rear-view of a top-opening nursing bra of the prior art having a known quick release fastener in its coupled configuration.

An example of a conventional top-opening nursing bra 2 of the prior art is illustrated in FIGS. 2A, 2B and 2C. A conventional top-opening nursing bra 2 generally differs from a standard bra 1 in that each shoulder strap-breast cup juncture comprises a quick release fastener 20 having mating, coupled, interacting first and second portions 22, 24 that are connected to the bra shoulder strap 12 and breast cup strap 14, respectively. The quick release fastener second portion 24 may be connected directly to the breast cup 4 or to a strap 14 extending from the breast cup 4. Additionally a sling strap 40 is connected to the quick release fastener first portion 22 at a top end 42 of the sling strap 40 and to the torso band 6 at a bottom end 44 of the sling strap 40, with the function of retaining the shoulder strap 12 in position when the quick release fastener 20 is in an open configuration, thereby allowing selective and repeated one-handed coupling and uncoupling of the quick release fastener portions 22, 24 by the user. When in use and the quick release fastener 20 is in its coupled configuration, as illustrated in FIGS. 2A and 2C, the nursing bra functions in an analogous manner to a standard bra and the quick release fastener 20 and sling strap 40 may have no appreciable effect on standard bra functionality. When the wearer wishes to expose a breast for nursing, she simply opens the quick release fastener 20 by uncoupling the second portion 24 from the first portion 22 and lowers the quick release fastener second portion 24 and breast cup 4 to expose the breast for feeding. While the quick release fastener 20 is in its open configuration, as illustrated in FIG. 2B, the sling strap 40 functions to hold the shoulder strap 12 and quick release fastener first portion 22 in position while the breast cup is lowered so that when the feeding has finished the wearer may easily mate and couple the second portion 24 of the quick release fastener with the first portion 22 thereby placing the quick release fastener 20 in its coupled configuration and covering the breast to resume standard bra functionality. Ideally the quick release fastener 20 may be manipulated between open and closed configurations using one hand only. The skilled person in the art would appreciate that the sling strap 40 may take various forms known in the art. Throughout this application the term "sling strap" is intended to include all types of straps which extend from a quick release fastener first portion to a bra torso band in order to maintain the position of the shoulder strap when the quick release fastener is open. The term "sling strap" shall be construed as including, but not limited to: a single elongate member, multiple elongate members, members exhibiting flared or trumpet-like bottom ends, members exhibiting straight bottom ends, members configured to encircle the breast of the wearer.

Figure 3B:
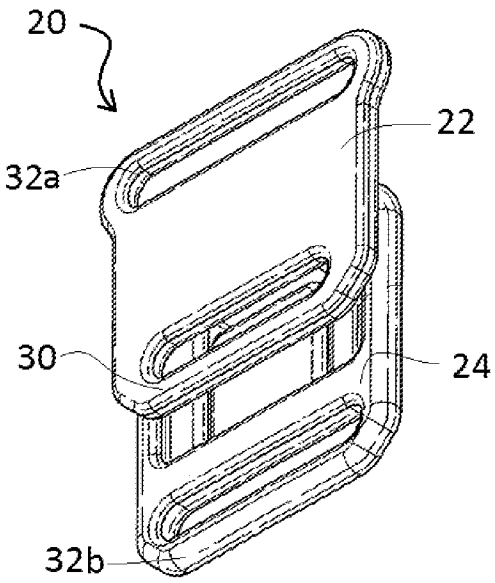
FIG. 3B depicts a rear view of a popular style of nursing bra quick release fastener of the prior art, in its coupled configuration.
Figure 3A:
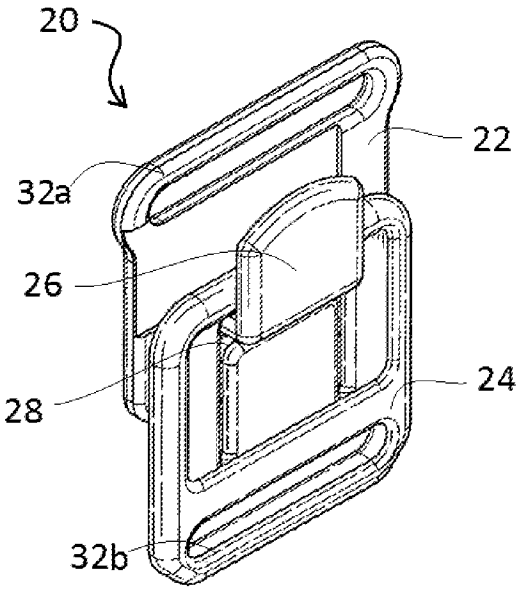
FIG. 3A depicts a front view of a popular style of nursing bra quick release fastener of the prior art, in its coupled configuration.

An example of a popular style of nursing bra quick release fastener of the prior art, as illustrated in FIGS. 3A and 3B, and as shown in the prior art nursing bra of FIGS. 2A, 2B and 2C, comprises a nursing bra clip 20 that features first and second portions 22, 24, wherein the first portion 22 is positioned proximally and, typically, superiorly on the wearer relative to the second portion 24. The quick release fastener first portion 22 features a resilient hooked protrusion 26 and the second portion 24 features a complementary opening 28 which couples with the hooked protrusion 26 to securely retain the hooked protrusion 26 therein. Retaining structures such as retaining bars 32*a*, 32*b* on the first and second portions 22, 24, respectively, are provided as attachment points for nursing bra shoulder strap 12 and cup strap 14, respectively. Sling strap retaining structure 30 is provided on the first portion 22 as an attachment point for sling strap top end 42. Conventionally, sling strap bottom end 44 is attached to the torso band 6. Thus, the sling strap 40 provides a secondary anchoring point for the shoulder strap 12 (besides being attached at the cup 4 via second portion 24), so that when the quick release fastener portions 22, 24 are uncoupled and the cup 4 is lowered for breastfeeding the shoulder strap 12 and first portion 22 remain stationary, facilitating easy one handed re-coupling when the feeding has concluded. When the wearer wishes to replace the breast cup 4 to resume standard bra functionality she simply engages the opening 28 of the second portion 24 over the protrusion 26 of the first portion 22 to securely couple the first and second portions 22, 24 together. The nursing bra quick release fastener described and illustrated herein is merely intended to serve as an example and is not to be understood as limiting to the scope of the invention. A person of skill in the art would readily appreciate that a wide variety of quick release fasteners would similarly be suitable for application as a nursing bra quick release fastener. Other suitable types of quick release fasteners may include but are not limited to: hook and loop fasteners, button and loop closures, magnetic closures, hook and eye closures, snap fasteners, spring loaded clips, suspender clips. The quick release fastener may comprise a resiliently deformable element such that coupling and uncoupling of the first and second portions can be gained by deformation of a part of the fastener which then resiliently recovers to promptly secure the first and second portions together. The sling strap, shoulder strap or breast cup strap may be retained by retaining means other than those illustrated herein, as would be appreciated by a person of skill in the art.

The object of the present invention is to empower an ordinary lay person to convert a standard bra into a top-opening nursing bra with minimal time and skill and requiring no specialized tools or sewing. A first embodiment 110 of the device of the present invention is illustrated in FIGS. 4A, 4B, 4C and 4D and comprises a quick release fastener 20 such as that previously described or, for example, illustrated in FIGS. 3A and 3B, having a first portion 22 and a second portion 24. The first portion 22 of the quick release fastener 20 is attached to an upper fastener 122—this combination is heretofore referred to as the upper assembly 100. Upper assembly 100 is attached to a sling strap top end 42 via a retaining structure such as a retaining bar 30, as shown in prior art quick release fastener of FIGS. 3A and 3B. The second portion 24 of the quick release fastener 20 is attached to a lower fastener 124—this combination is heretofore referred to as the lower assembly 102. The sling strap bottom end 44 is connected to a band fastener 126 at a band fastener retaining structure such as a retaining bar 138.

Figure 4A:
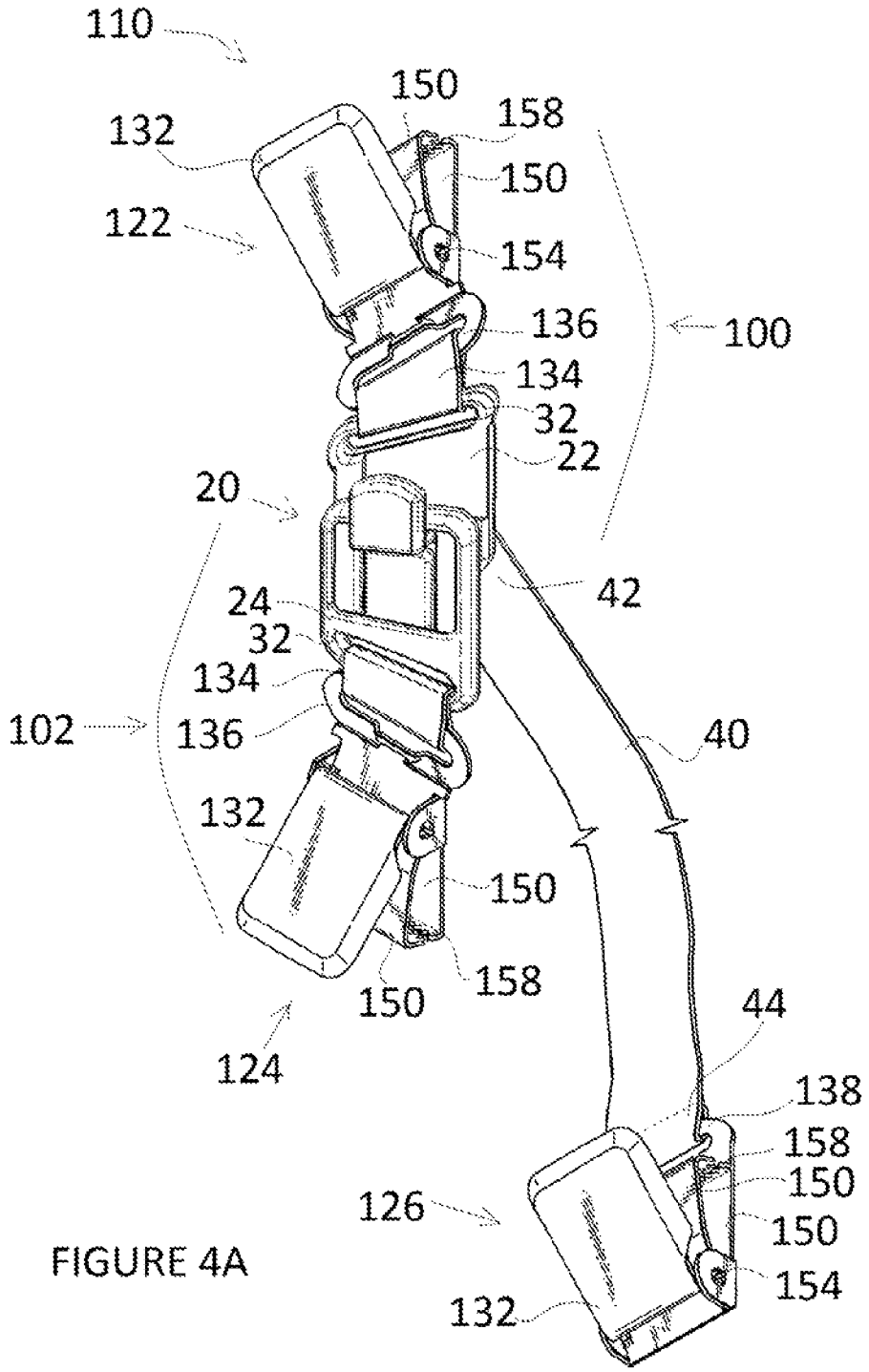
FIG. 4A depicts a first embodiment of the device of the present invention.
Figure 4B:
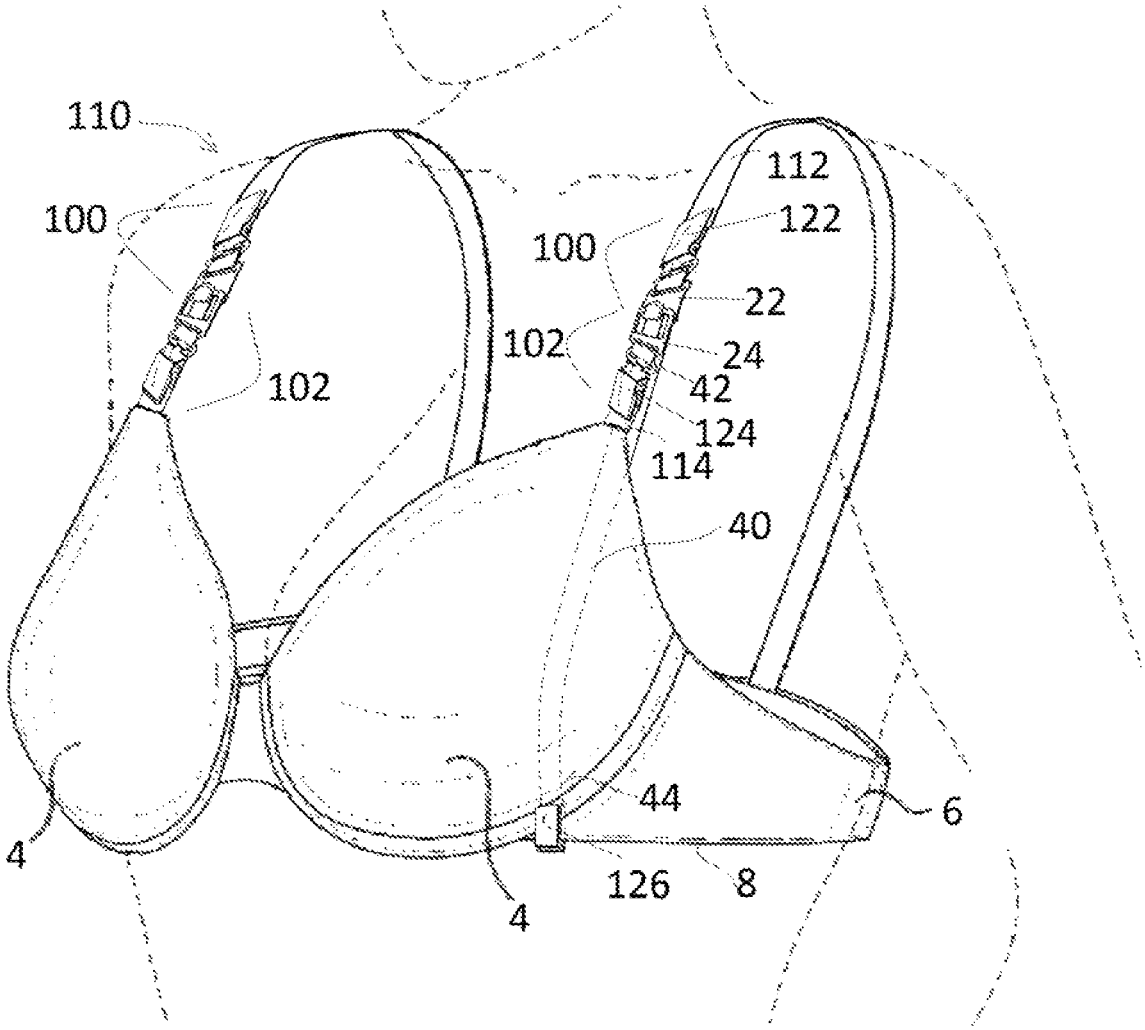
FIG. 4B depicts the device of FIG. 4A when installed to convert a standard bra into a nursing bra.
Figure 4C:
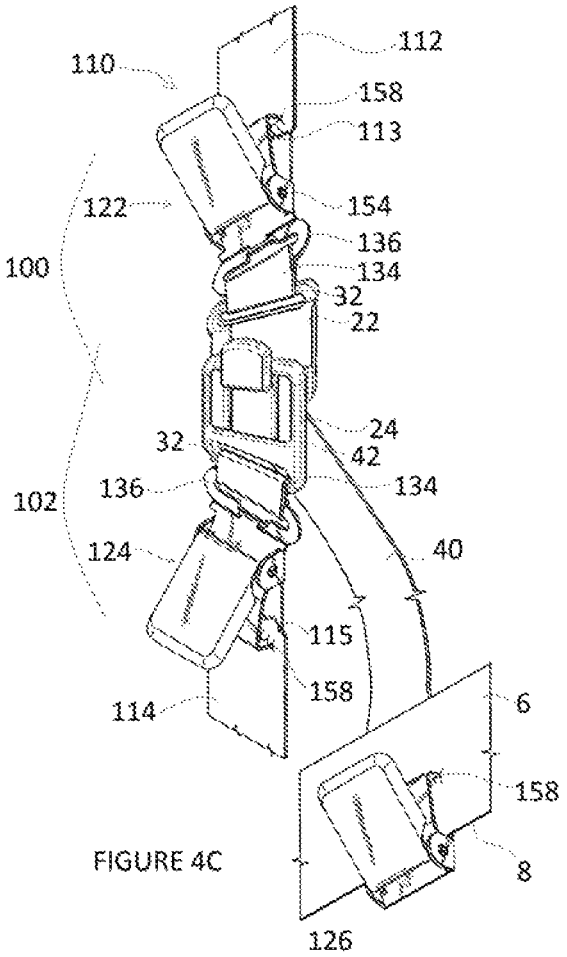
FIG. 4C depicts an enlargement of first embodiment of the device during installation thereof.
Figure 4D:
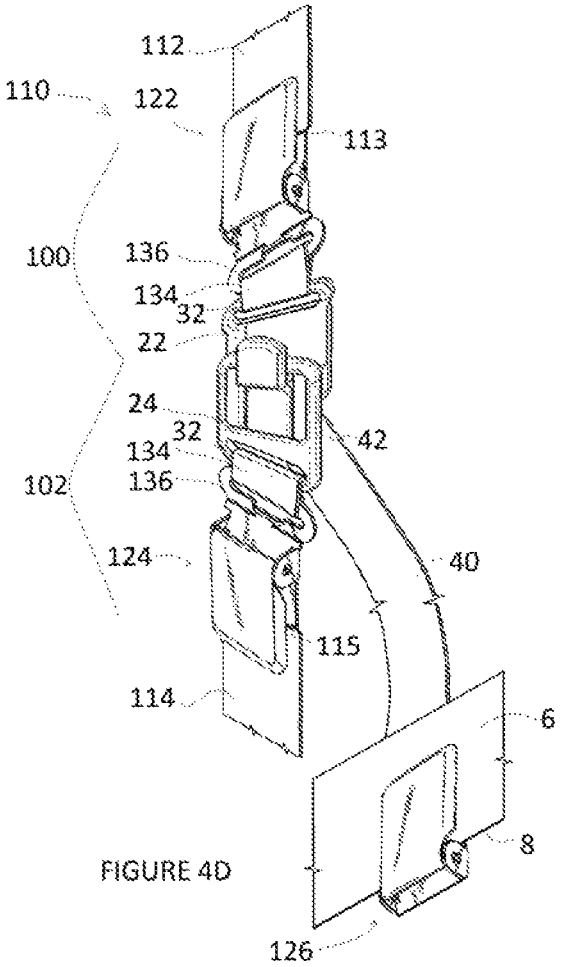
FIG. 4D depicts an enlargement of the first embodiment of the device when installed to convert a standard bra into a nursing bra.
Figure 5C:
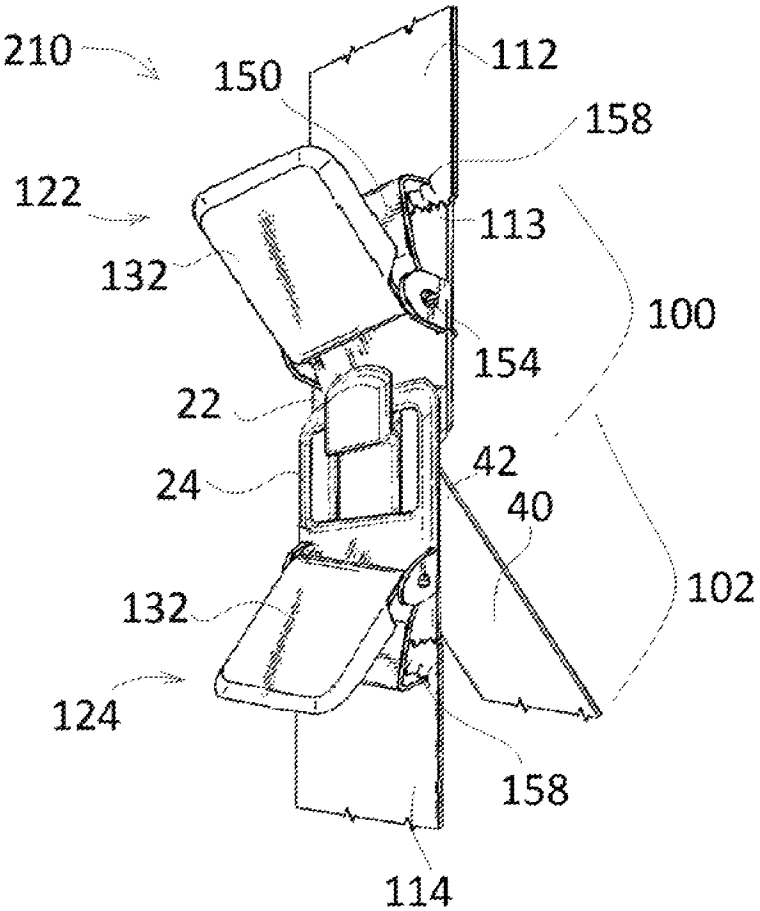
FIG. 5C depicts an enlargement of the embodiment of the device having integrally formed upper and lower assemblies, during installation thereof.
Figure 5A:
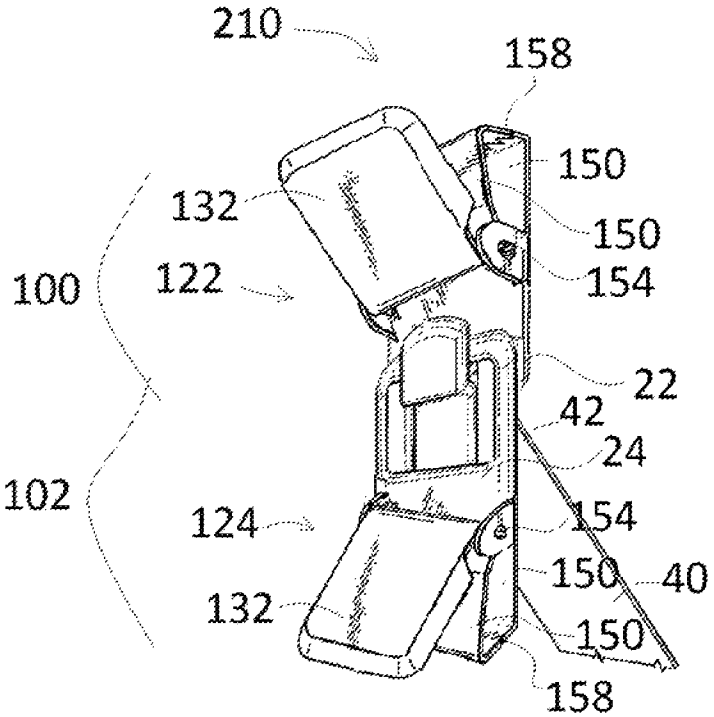
FIG. 5A depicts an embodiment of the device of the present invention wherein the upper and lower assemblies are integrally formed.
Figure 5B:
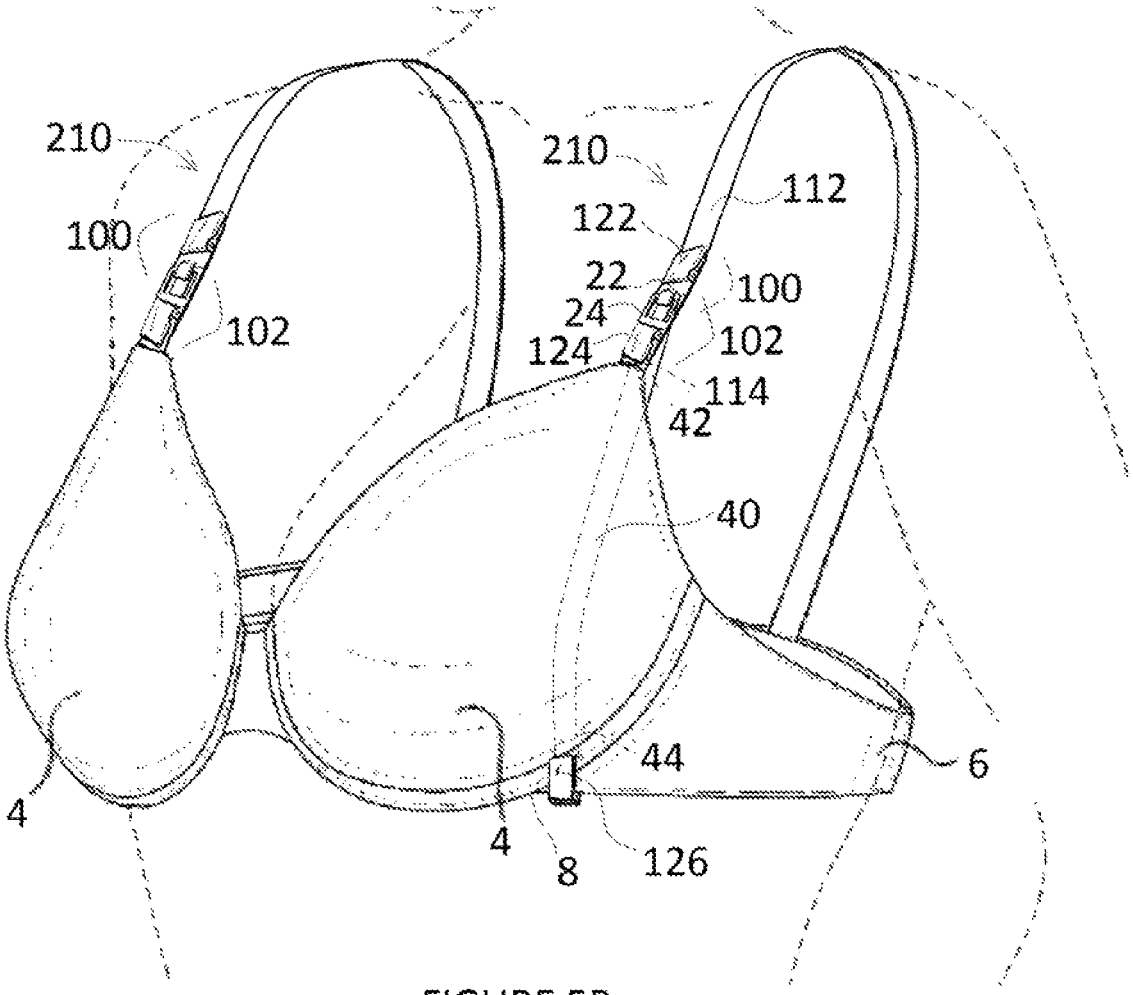
FIG. 5B depicts an embodiment of the device having integrally formed upper and lower assemblies, when installed to convert a standard bra into a nursing bra.

When installing the device of the present application to convert a standard bra into a nursing bra the user simply performs four steps. She severs the standard bra shoulder strap 10 near the breast cup 4 resulting in a shoulder strap portion 112 having a severed end 113 and a cup strap portion 114, also having a severed end 115. Then, she securely fastens the upper fastener 122 over the severed shoulder strap end 113 onto the shoulder strap portion 112 of the strap, securely fastens the lower fastener 124 over the severed cup strap end 115 onto the cup strap portion 114 of the strap, and securely fastens the band fastener 126 over a lower edge 8 of the torso band 6, having oriented the band fastener 126 so that the sling strap retaining structure 138 of the band fastener 126, which provides an attachment point to retain the bottom end 44 of the sling strap 40, is placed on the interior (wearer-facing) side of the torso band 6. The band fastener 126 must be connected to the torso band 6 such that, when worn, the sling strap 40 lies between the body of the user and the inside surface of the bra. The band fastener 126 should be attached to the torso band 6 at a location that will allow the sling strap 40 to extend to the upper assembly 100 and serve to maintain the shoulder strap 112 in a standard position when the cup 4 is lowered, but will do so without interfering with breastfeeding. A typical sling strap bottom end attachment point may be near the bottom of the cup 4 and laterally off-center with respect to the breast, as known in the prior art and as is shown in FIGS. 2C, 4B and 5B. A skilled person in the art would appreciate that an optimal connection location of the band fastener would vary with the style of bra, design of sling strap and preference of the user. A person of skill in the art would also appreciate that the upper, lower and band fasteners 122, 124, 126, may be fastened in any order without consequence. The sling strap is preferably comprised of an elastic member and may comprise sizing provisions for adjusting the length thereof and, if so, the user may adjust the length of the sling strap to suit her needs before or after attaching the band fastener 126 to the torso band 6. The term "band fastener" may signify multiple individual fasteners if the width of the sling strap bottom end would benefit from the use of multiple fasteners, as determined by a person of ordinary skill in the art.

Throughout this application the term "band fastener" shall be understood as encompassing single or multiple fasteners so long as they serve the function of attaching the span of the bottom end of the sling strap to the bra torso band. Sizing provisions for the sling strap may include a slider or any other suitable length-adjusting mechanism as would be contemplated by a person of ordinary skill in the art. A fastener is fastened by placing it, in an open state, at the desired location and then by engaging the fastener by closing it over the strap or band, rendering it in an engaged state. The fastener may then be locked in place if a locking mechanism is provided.

Thus, when the device is installed, the upper fastener 122 is securely fastened to a severed standard bra shoulder strap 112, the lower fastener 124 is securely fastened to a severed breast cup strap 114, and the band fastener 126 is fastened to a standard bra torso band 6. This converts a standard bra 1 into a nursing bra which is analogous to that of the prior art, rendering it functionally equivalent and operable in the same manner. A converted bra is shown in FIGS. 4B and 5B. Once the bra has been converted, to expose the breast for breastfeeding the user simply uncouples the quick release fastener first portion 22 from the second portion 24 and lowers the cup 4, as she would if she were using a nursing bra of the prior art (such as illustrated in FIGS. 2A, 2B and 2C). The quick release fastener first portion 22 remains stationary because it is attached to the upper fastener 122, severed shoulder strap 112, sling strap 40, and torso band 6 (via the band fastener 126). The second portion 24 of the quick release fastener 20 remains attached to the breast cup 4 because it is connected via the lower fastener 124 which was securely fastened to the severed cup strap 114. When the feeding has concluded and the user wishes to replace the cup 4 and resume standard bra functionality she simply couples the quick release fastener first and second portions, 22 and 24, respectively, as she would if using a nursing bra of the prior art.

The upper fastener 122, lower fastener 124 and band fastener 126 may take various forms, as would be appreciated by a person of skill in the art. These fasteners are intended to securely grip the severed bra shoulder strap 112 and severed cup strap 114 over raw edges 113, 115 thereof, and to securely grip bra torso band 6 over the loweredge 8 thereof, respectively. When installed into their engaged and/or locked states, the fasteners 122, 124, 126 are intended to remain engaged and/or locked and withstand normal use and laundering of the bra. They may be releasable or permanent. A suitable fastener embodiment is illustrated, by example only, in FIGS. 4A, 4B, 4C, 4D, 5A, 5B, 5C and 6, and may comprise jaw portions 150, a hinge portion 154 and gripping features 158 on inside surfaces of the jaw portions 150. Gripping features 158 are provided for engaging and frictionally holding a strap portion or torso band when the fastener is in an engaged state and/or locked state and are intended to apply friction to resist sliding or pull-out of the strap material with respect to the fastener during normal use and laundering. Gripping features may comprise many known gripping features in the art of fasteners such as teeth, spikes, barbs, high-friction coatings such as rubber, or a combination of such things, as would be appreciated by a person of skill in the art. If teeth, spikes or barbs are employed they may be sharp so as to pierce the fabric of the shoulder strap, cup strap and/or torso band, and may be angled with respect to these surfaces in order to resist pullout or slippage. Gripping surfaces may comprise an area of any suitable shape and size and may comprise any number and configuration of gripping features, as determined by a person of skill in the art. Any of the upper, lower and/or band fasteners may comprise a locking mechanism which acts to reversibly or irreversibly lock the fastener in an engaged state.

A preferred type of locking fastener, as illustrated in FIGS. 4A, 4B, 4C, 4D, 5A, 5B, 5C and 6, comprises a hinge portion 154 connected to jaw portions 150 having gripping features 158. An example of a fastener 122, 124, 126 having a locking lever 132 is illustrated in FIGS. 4A, 4B, 4C, 4D, 5A, 5B, 5C and 6. In this embodiment, the fastener 122, 124, 126 is in an engaged state when the jaw portions 150 and gripping features (the teeth) 158 are closed around the associated strap 112, 114 or band 6 (see FIGS. 4C and 5C), and in a locked state when the locking mechanism (the lever) 132 is clamped shut over the jaw members 150 (see FIGS. 4B, 4D and 5B).

Figure 7:
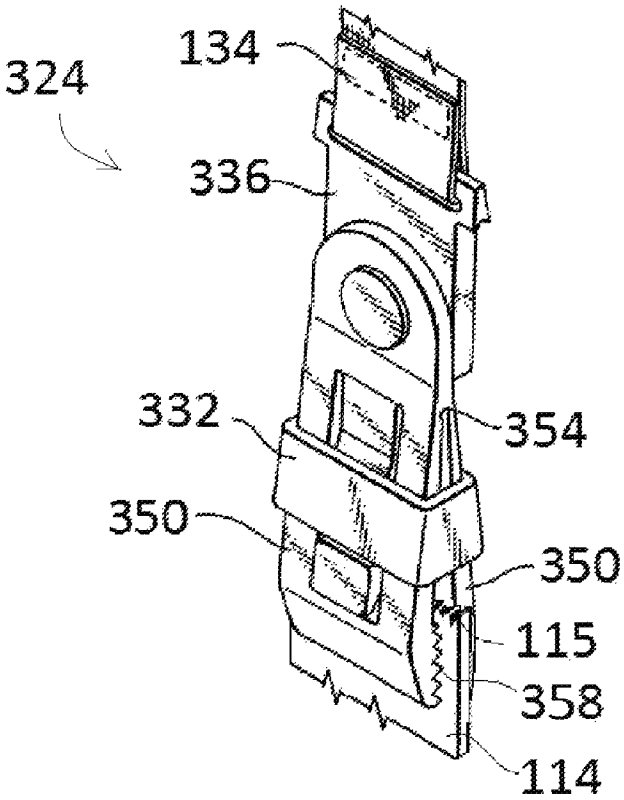
FIG. 7 depicts an example of an alternative locking fastener design.

FIG. 7 depicts an example of an alternative option of the prior art for a lower locking fastener 324, the design of which could be employed for use as upper, lower or band fastener. This fastener comprises jaw members 350 connected by hinge 354, the jaw members 350 having gripping surfaces with gripping features 358. The fastener can be locked in an engaged state with a ratcheting locking slider collar 332. Retaining structure 336 is provided for connection with quick release fastener second portion 24 via linking element 134, however the retaining structure 336 may be eliminated if an integral design is preferred, or relocated if being used as band fastener, as discussed in the present document.

Any suitable locking mechanism may be employed for the purposes of securely locking the fasteners in an engaged state. Examples of suitable locking mechanisms include but are not limited to: locking levers, locking sliders, locking dials, detents, toggles, ratchet mechanisms. Fasteners having deformable tabs for rendering the fastener locked in a permanently engaged state have also been contemplated. Fasteners with locking mechanisms requiring tools such as crimps or screws have also been contemplated. The term "locking mechanism" shall be construed to include any mechanism by which the fastener may be reversibly or irreversibly locked in an engaged state.

The upper and lower assembly fasteners 122, 124 of FIGS. 4A, 4B, 4C and 4D comprise a linking element retaining structure 136 for accommodating a permanent connection to a linking element 134 for connection with the quick release fastener first or second portion via linking element retaining structure 32. Alternatively, as illustrated at 210 in FIGS. 5A, 5B and 5C, upper and lower fasteners 122, 122, 124 may optionally be connected integrally with the quick release fastener first and second portions 22, 24, respectively, and would then not require linking element retaining structures to connect these parts together.

A sling strap retaining structure is preferably used and would be found anywhere on the upper assembly 100 and provides a site for permanent connection with the sling strap top end 42. As illustrated in FIG. 3B, the sling strap retaining bar 30 of the first portion 14 of the known quick release fastener 12 would be a suitable sling strap retaining structure for the upper assembly. Alternatively an upper assembly linking element retaining structure 32 or 136 could simultaneously perform the function of sling strap retaining structure. A person of skill in the art would appreciate that a sling strap retaining structure could be any feature which holds the top end of the sling strap in permanent connection with the upper assembly. Similarly, a linking element retaining structure could be any feature that holds the linking element in permanent connection with the quick release fastener or upper/lower fastener. A retaining structure may include a retaining bar, pin, clamp, adhesive, a combination of such things, or other suitable embodiment as determined by a person of skill in the art. A linking element may comprise any design and material which functions to connect the quick release portion with the fastener, as contemplated by a person of ordinary skill in the art. In one embodiment the linking element comprises elastic material similar to that of the bra shoulder strap, as shown in FIGS. 4A, 4B, 4C and 4D, but the linking element may comprise any suitable connector material. The use of webbing material, hinge connections, snap fit connections, braided, woven or wrapped joints, or many other types of connector may be suitable to attach the upper and/or lower fasteners to the quick release fastener first and/or second portions. As the embodiments presented herein are merely exemplary they shall not be construed as restricting to the scope of the invention. As the upper end of the sling strap may be connected directly to the shoulder strap, a person of skill in the art may choose to forego a sling strap retaining structure on the upper assembly altogether.

Figure 6:
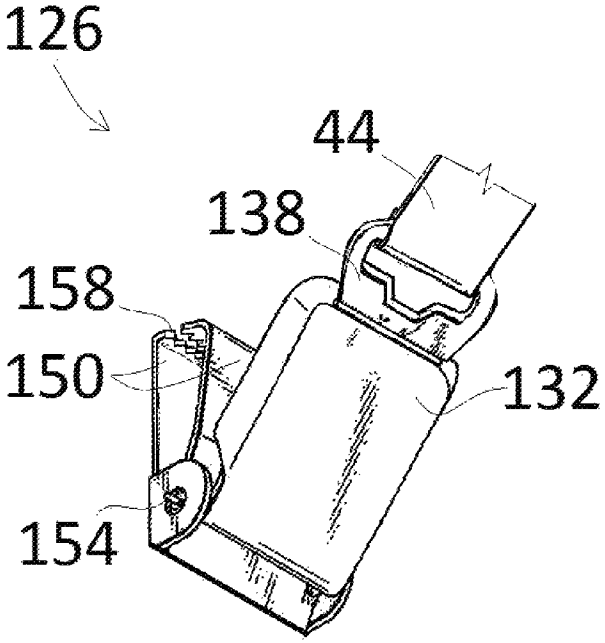
FIG. 6 depicts a band fastener having an alternative placement location for the sling strap retaining structure.

As previously mentioned, when the band fastener is installed the sling strap should extend from the interior side of the torso band, which is to say on the side of the torso band that is in contact with the body of the user when worn. In a preferred embodiment the band fastener retaining structure 138 may be located on the superior end of a jaw portion 150 of the band fastener 126, as illustrated in FIG. 4A, such that when the band fastener 126 is in its engaged state on the bra torso band 6 and in a preferred orientation—in which the band fastener 126 has been fastened over the lower edge 8 of the torso band 6 with the jaw portions 150 oriented superiorly relative to the hinge portion 154 (see FIGS. 4B, 4C, 4D and 5B)—the placement of the band fastener sling strap retaining structure 138 allows the sling strap 40 to naturally extend directly from the jaw portion 150, upwardly and alongside the body of the user, sandwiched between the body of the user and the bra, to the quick release fastener upper assembly 100. It is important for the band fastener retaining structure 138 to be located on a portion of the band fastener 126 that is situated on the inside side of the torso band 6 when installed. Preferably it is located at a superior part of a jaw portion 150 of the fastener. It has been contemplated that the torso band retaining structure 138 may be situated on another portion of the fastener such as on the locking mechanism 132, as illustrated in FIG. 6, if it were oriented on the inside (body-facing) side of the torso band 6 when installed. A person of skill in the art would appreciate that the band fastener retaining member may be located anywhere on the band fastener that would allow the sling strap to extend between the body of the user and the inside surface of the bra to intersect the shoulder strap portion at the upper assembly, so long as normal function of the band fastener and upper assembly are preserved. If the sling strap retaining member is not located adjacent the jaw portion of the fastening member, a guide member may be provided on the fastener to guide and retain the sling strap in alignment with the fastener body to avoid skewing of the strap with respect to the fastener. As the examples discussed herein are intended as being exemplary they should not be construed as limiting to the scope of the claims.

Upper, lower and/or band fasteners may comprise a biasing member for applying pressure to the gripping surfaces. The upper, lower and band fasteners may be different from, or may be identical to, one another. The fasteners are preferably sized and shaped with a low or flat profile such that they are invisible under clothing. Fasteners may comprise any suitable material such as metal or plastic and may comprise a surface coating such as paint, or they may comprise a combination of materials. Examples of fasteners known in the art which may be appropriate as upper, lower and/or band fasteners may include clips, clasps, clamps, crimps, suspender clips, alligator clips, locking clips, slider clips, C-clips. Fasteners may require tools for manipulation thereof, or may be of a type which can be manipulated without tools. The illustrated fasteners are provided as mere examples and are not intended to be limiting to the scope of the invention. Other known fasteners with or without locking mechanisms or retaining structures and with variations in design of locking mechanisms, hinge portion, jaw portion, gripping surfaces, gripping features and retaining structures may similarly be appropriate for use, as would be appreciated by a skilled person in the art.

As it may be desirable to select and incorporate the sling strap oneself, a person of skill in the art would appreciate that the coupled upper and lower assemblies may be useful as a device in itself without the inclusion of the sling strap and band fastener.

To install the device, a user: 1) severs a standard bra shoulder strap 10 at a location adjacent to the breast cup resulting in a shoulder strap severed end and a cup strap severed end; 2) fastens the upper fastener over the shoulder strap severed end to securely attach it thereto in a closed state; 3) fastens the lower fastener over the cup strap severed end to securely attach it thereto in a closed state; and 4) fastens the band fastener over a lower edge of the bra torso band to securely attach it thereto, whereby the band fastener is engaged at a location which will allow the sling strap to extend between the body of the user and the bra cup without interfering with breastfeeding; whereby steps 2) through 4) may be performed in any order. If a locking mechanism is provided, the fasteners can be locked in place as appropriate.

The band fastener is to be engaged at a suitable location over the lower edge of the torso band, preferably such that the sling strap will lay flat against the body when worn between the body of the user and the interior surface of the bra cup. In the case of a bra which does not have a distinct band member below the cup, the band fastener may be attached to the lower edge of the bra cup. A suitable attachment location is up to the user and varies with the configuration of the sling strap and bra. An elongate sling strap would preferably extend in approximately the same line as the shoulder strap to intersect with the shoulder strap at the upper assembly, and would attach to the band off-centre and outwardly relative to the nipple location, as is known in the art. Widened or trumpet-shaped sling straps would attach to the torso band at logical locations along the band in order to lay flat against the body when worn, as is known in the art. Optionally the user may adjust the sling strap and shoulder strap lengths in order to achieve an optimal fit. Optionally, the user may prefer to attach the band fastener first before severing the shoulder strap to achieve optimal placement of the upper and lower assemblies and reduce slack length in the sling strap. The user would generally proceed to repeat the installation steps on the other, non-converted, standard bra strap in order to achieve a symmetrically functional top-down nursing bra.

If the fasteners are releasable the user has the option to revert the bra to standard bra form once the top-down nursing bra configuration is no longer desired by releasing the fasteners and re-attaching the severed shoulder strap ends together by sewing or other means.

The invention claimed is:

1. A device for converting a standard bra into a nursing bra, comprising:

an upper assembly comprising an upper fastener attached to a first portion of a quick release fastener, the upper fastener being configured for securely gripping a severed shoulder strap of said standard bra;

a lower assembly comprising a lower fastener attached to a second portion of the quick release fastener, the lower fastener being configured for securely gripping a severed breast cup strap of said standard bra;

a band fastener configured for securely gripping a bra torso band of said standard bra; and a sling strap having a top end and a bottom end, wherein the sling strap top end is attached to the upper assembly and wherein the sling strap bottom end is attached to the band fastener; and wherein the quick release fastener first and second portions can be selectively coupled and uncoupled.

2. The device of claim 1, wherein the upper fastener, lower fastener and/or band fastener comprises a jaw having opposing jaw portions and a hinge member, wherein the jaw portions are pivotable at the hinge member to move the jaw between opened and closed states, and wherein the jaw portions comprise gripping features on inside surfaces thereof.

3. The device of claim 2, wherein the gripping features include teeth, barbs, spikes, a friction material, or a combination thereof.

4. The device of claim 3, wherein the teeth, spikes and/or barbs are configured to pierce the severed shoulder strap and/or torso band when fastened.

5. The device of claim 3, wherein the friction material comprises a natural or synthetic rubber.

6. The device of claim 1, wherein the band fastener is configured for gripping the bra torso band over a lower edge thereof.

7. The device of claim 1, wherein the band fastener further comprising a band fastener retaining structure that is configured for retaining the sling strap bottom end thereon, wherein the band fastener retaining structure is positioned at a superior region and on an inside portion of the band fastener.

8. The device of claim 1, wherein the upper fastener is formed integrally with the quick release fastener first portion.

9. The device of claim 1, wherein the upper fastener is attached to the quick release fastener first portion via a linking element.

10. The device of claim 1, wherein the lower fastener is formed integrally with the quick release fastener second portion.

11. The device of claim 1, wherein the lower fastener is attached to the quick release fastener second portion via a linking element.

12. The device of claim 1, wherein the upper fastener, lower fastener and/or band fastener further comprises a jaw, and wherein the jaw comprises a locking mechanism for locking the jaw in said closed state.

13. The device of claim 12, wherein the locking mechanism comprises a locking lever, slider, toggle, ratchet, deformable tab, dial, screw, or any combination thereof.

14. The device of claim 12, wherein the locking mechanism may be manipulated by hand.

15. The device of claim 12, wherein the locking mechanism requires the use of a tool for manipulation thereof.

16. The device of claim 1, wherein the upper fastener, lower fastener and/or band fastener is releasable.

17. The device of claim 1, wherein the upper fastener, lower fastener and/or band fastener is non-releasable.

18. The device of claim 1, wherein the upper fastener, lower fastener and/or band fastener is a crimp, a clasp, a clamp, a snap, a suspender clip or an alligator clip.

19. The device of claim 1, wherein the upper fastener, lower fastener and/or band fastener includes a biasing member.

20. The device of claim 1, wherein the upper fastener, lower fastener and/or band fastener features a flat or low profile when fastened so as to be invisible under clothing.

21. The device of claim 1, wherein the upper fastener, lower fastener and/or band fastener comprise plastic and/or metal.

22. The device of claim 21, wherein the upper fastener, lower fastener and/or band fastener comprise a painted surface coating.

23. The device of claim 1, wherein the sling strap is adjustable in length.

24. The device of claim 1, wherein the band fastener comprises multiple fasteners positioned along a span of the sling strap bottom end.

25. The device of claim 1, wherein the sling strap comprises an elastic material.

26. The device of claim 1, wherein the quick release fastener comprises a nursing bra clip, a hook and loop fastener, a button and loop closure, a snap closure, a hook and eye closure, or a magnetic closure.

27. The device of claim 1, wherein the quick release fastener comprises a resiliently deformable element.

28. The device of claim 1, wherein the quick release fastener first portion is configured to be positioned proximally to a body of a wearer compared to the quick release fastener second portion when the fastener portions are coupled while the bra is being worn.

29. The device of claim 28, wherein the quick release fastener first portion is located superiorly relative to the quick release fastener second portion when the fastener portions are coupled while the bra is being worn.

30. A method of converting a standard bra into a nursing bra using the device of claim 1, the method comprising the steps of:

a) severing the bra shoulder strap into a shoulder strap portion having a shoulder strap severed end, and a cup strap portion having a cup strap severed end;

b) fastening the upper fastener over the shoulder strap severed end to securely attach it to the bra shoulder strap portion;

c) fastening the lower fastener over the cup strap severed end to securely attach it to the cup strap portion; and d) fastening the band fastener over a lower edge of the torso band or bra cup to securely attach it thereto, whereby the band fastener is engaged such that during use the sling strap extends from an interior side of the torso band;

whereby steps b) through d) may be performed in any order.

31. A method of converting a standard bra into a nursing bra using the device of claim 1, the method comprising the steps of:

a) fastening the band fastener over a lower edge of the torso band to securely attach it thereto, whereby the band fastener is fastened such that the sling strap extends from an interior side of the torso band to intersect the bra shoulder strap at the upper assembly;

b) severing the bra shoulder strap into a severed shoulder strap portion having a shoulder strap severed end, and a severed cup strap portion having a cup strap severed end, wherein the bra shoulder strap is severed at a location which is determined by an intersection of the upper assembly and the bra shoulder strap;

c) fastening the upper fastener over the shoulder strap severed end to securely attach it to the severed bra shoulder strap portion; and d) fastening the lower fastener over the cup strap severed end to securely attach it to the severed cup strap portion; and whereby steps c) through d) may be performed in any order.

32. The method of claim 30 or 31, further comprising the step of adjusting a length of the sling strap and/or bra shoulder strap portions.

33. The method of claim 30 or 31, further comprising the step of locking the upper fastener, lower fastener and/or band fastener after fastening said fastener(s).

34. A device for converting a standard bra into a nursing bra comprising:

a quick release fastener having first and second portions;

an upper fastener connected to the first portion of the quick release fastener, thereby forming an upper assembly unit;

a lower fastener connected to the second portion of the quick release fastener, thereby forming a lower assembly unit;

and further comprising a retaining structure that is provided on the upper assembly unit, said retaining structure providing an attachment location for a sling strap top end.

35. The device of claim 34, wherein the quick release fastener first portion is integrally connected to the upper fastener and/or the quick release fastener second portion is integrally connected to the lower fastener.

36. The device of claim 34, wherein the quick release fastener first portion is connected to the upper fastener via a linking element and/or wherein the quick release fastener second portion is connected to the lower fastener via a linking element.

37. The device of claim 34, wherein the upper fastener and/or lower fastener comprises a jaw having opposing Jaw portions and a hinge member, wherein the jaw portions are pivotable at the hinge member to move the jaw between opened and closed states, and wherein the jaw portions comprise gripping features on inside surfaces thereof.

38. The device of claim 37, wherein the gripping features include teeth, barbs, spikes, a friction material, or a combination thereof.

39. The device of claim 38, wherein the teeth, spikes and/or barbs are configured to pierce the bra shoulder strap and/or torso band when fastened.

40. The device of any one of claim 1, 30, 31 or 36, wherein at least one of the upper fastener, lower fastener and band fastener comprises at least one piercing member.

41. The device of claim 37, wherein the upper fastener and/or lower fastener further comprises a locking mechanism for locking the jaw in said closed state.

42. The device of claim 41, wherein the locking mechanism comprises a locking lever, slider, toggle, ratchet, deformable tab, dial, screw, or any combination thereof.

43. The device of claim 41, wherein the locking mechanism may be manipulated by hand.

44. The device of claim 41, wherein the locking mechanism requires the use of a tool for manipulation thereof.

45. The device of claim 34, wherein the upper fastener and/or lower fastener is releasable.

46. The device of claim 34, wherein the upper fastener and/or lower fastener is non-releasable.

47. The device of claim 34, wherein the upper fastener and/or lower fastener is a crimp, a clasp, a clamp, a snap, a suspender clip or an alligator clip.

48. The device of claim 34, wherein the upper fastener and/or lower fastener includes a biasing member.

49. The device of claim 34, wherein the upper fastener and/or lower fastener features a flat or low profile when fastened so as to be invisible under clothing.

50. The device of claim 34, wherein the upper fastener and/or lower fastener comprise plastic and/or metal.

51. The device of claim 50, wherein the upper fastener and/or lower fastener comprise a painted surface coating.

52. The device of claim 34, wherein the quick release fastener comprises a nursing bra clip, a hook and loop fastener, a button and loop closure, a snap closure, a hook and eye closure, or a magnetic closure.

* * * * *